US006009777A

United States Patent [19]

Jarvis

[11] Patent Number: 6,009,777

[45] Date of Patent: Jan. 4, 2000

[54] SOCKET WRENCH AND RATCHET ATTACHMENT MEANS

[76] Inventor: Jack D. Jarvis, 3204 Periwinkle, Memphis, Tenn. 38127

[21] Appl. No.: 09/187,374

[22] Filed: Nov. 6, 1998

Related U.S. Application Data

[60] Provisional application No. 60/065,529, Nov. 13, 1997.

[51] Int. Cl.[7] ..... B25B 13/46

[52] U.S. Cl. ..... 81/60; 81/63.1

[58] Field of Search ..... 81/58, 58.4, 60, 81/61, 62, 63, 63.1, 63.2

[56] References Cited

U.S. PATENT DOCUMENTS 1,769,070 7/1930 Nowosielski ..... 81/60

3,572,188 3/1971 Christian, Jr. ..... 81/58.1

*Primary Examiner*—Timothy V. Eley
*Assistant Examiner*—Willie Berry, Jr.
*Attorney, Agent, or Firm*—Paul M. Denk

[57] ABSTRACT

A socket wrench and ratchet attachment, including a wrench housing, a wrench handle that threadedly engages within the housing, the housing having an opening therein, into which a socket wrench or ratchet may snugly insert, and be bound into position for usage, upon turning of the handle into an engaging position. The handle has a series of stepped down extensions, that matingly fit within a bore and counterbore formed within the wrench housing, to provide for there mating engagement, when locking a socket wrench or ratchet into a position of utility.

1 Claim, 1 Drawing Sheet

SOCKET WRENCH AND RATCHET ATTACHMENT MEANS

CROSS-REFERENCE TO RELATED APPLICATION

This application is a non-provisional patent application based upon provisional patent application having Serial No. 60/065,529, filed on Nov. 13, 1997, which is owned by a common assignee.

BACKGROUND OF THE INVENTION

This invention relates generally to a means for securing a socket wrench and/or ratchet wrench to the handle of a tool. And, with the herein versatility of this particular device, any of a variety of ratchets, palm ratchets, socket wrenches, and related types of wrench means, may be used in conjunction with the unique handle of this means for providing ready availability of such a tool for prompt usage and application.

Socket wrenches are well known in the art. Likewise, ratchet wrenches are well known and used in the art. Generally, a socket wrench set has a number of interchangeable sockets that can be attached to a socket drive head, or ratchet, which is usually integrally connected to its drive handle.

Examples of various types of wrench means may be seen in U.S. Pat. No. 4,905,549, to Nickipuck. In addition, Nickipuck has a variety of other U.S. patents, such as Pat. No. 4,938,107, Pat. No. 4,480,511, and Pat. No. 4,768,405.

Various types of wrench means that are attachable to some form of handle can be seen in the prior patent to Sharp, No. 4,748,874, U.S. Pat. No. 4,791,837, to Maine, upon a speed wrench and hand grip combination. Furthermore, the U.S. Pat. No. 2,897,437, to Lozensky, shows a variation upon a ratchet wrench, that is pivotally connected to some form of a handle. Furthermore, the patent to Campbell, No. 1,371,350, shows another type of socket wrench set combination with handle.

Various types of means for holding the ratchet or socket wrench to its handle, generally in a pivotal formation, can be seen in the European patent No. EP-27-238, where the socket wrench head may be located at various angular relationships, with respect to its handle, and fixed in position thereat, once adjusted. The U.S. Pat. No. 5,291,809, to Fox, shows another type of locking adapter for a socket wrench. U.S. Pat. No. 5,289,745, shows means for attachment of a socket wrench extension, incorporating its integral lock, for connection with a wrench drive. U.S. Pat. No. 4,279,314, to Taub, shows an attachment means for connection with a ratchet wrench, for functioning as a drive for a nut and bolt assembly. Various other types of wrench means, where their handles are pivotally connected with respect to their ratchet, can be seen in the U.S. Pat. No. 4,324,158 to LeRoy. The patent to Little, U.S. Pat. No. 2,982,160, shows a spinner drive means for a ratchet wrench. These are all examples of prior art type of ratchets, that provide means for interconnection with their handles, and the like.

Generally speaking, prior art type of sockets, for use in conjunction with wrenches, are cylindrical in shape and have a square opening at one end for attachment to the socket drive head, and a round, internally faceted, work-piece engaging orifice at the other end. Typically, the work-piece is a nut or bolt. The sizes of the work-piece engaging orifice differ among the various interchanageable socket so that the user can change sockets depending upon the size of the nut or bolt.

As stated above, the socket drive head generally is integrally connected to a handle. The socket drive head has a rotatable square drive extending from one side. Within the head is a conventional ratcheting mechanism, the ratcheting mechanism is adjustable by an external switch or lever so that the ratcheting mechanism allows the square drive to rotate in opposite directions, for tightening or loosening of a nut or bolt, or other work piece. Since the socket drive head is integral to the handle, usually as forged metal, the handle cannot accommodate different sizes of socket drive heads having different sizes of square drives.

Another style of socket drive head is the palm ratchet, as aforesaid. The palm ratchet is a round drive head without a handle. The palm ratchet has a conventional square drive and internal ratcheting mechanism that can be held in the palm of the hand or fingers and rotated. The palm ratchets are useful in certain applications. However, the palm ratchet would be more versatile if it could be connected to a handle, if desired.

It is therefore advantageous to have a handle and interchangeable socket drive heads, in the form of ratchets, wherein the drive head is comprised of interchangeable, variable size palm ratchets, so that one handle can be used with different size palm ratchets, functioning as the drive head. Thus, the user could have multiple size palm ratchets for use in conjunction with a single wrench handle.

SUMMARY OF THE INVENTION

It is among the principal objects of the present invention to provide a socket wrench drive handle having interchangeable socket drive heads or ratchet means.

Another object of this invention is to provide a set of ratchet means that may be applied to a wrench handle, promptly, readily available for usage and application.

It is another object of the present invention to provide such a socket wrench drive handle and interchangeable ratchet drive heads wherein the palm ratchets are conveniently contoured for interfitting within the wrench handle, to provide various sized wrench sockets or drives for use in conjunction therewith.

In accordance with this invention, generally stated, a socket wrench drive handle and interchangeable, variable sized removable ratchets, or wrench socket drive heads, are provided. Regardless of whether ratchet means or wrench type socket heads are utilized, they are shaped and contoured in their configuration so as to be readily acceptable and tightened within an accompanying handle, locked into position, making the wrench sockets and ratchet means readily available for usage, upon instant application.

The handle attachment means of this invention includes an elongated handle, having a shouldered portion arranged forwardly thereof, and having an integral threaded means extending forwardly thereof, said handle cooperating with the ratchet holding head of particular design, and which is configured to readily accept the handle therein, for adjustment purposes, and for tightening of a ratchet or wrench socket therein. The wrench head includes a housing that extends laterally from its circularly configured socket, and the housing includes a series of bores or counterbores therein, which may e selectively threaded, so as to allow for the turning of the handle within the socket head, and to expose its threaded end or locking tab forwardly, within the apertured seat integrally provided within the wrench housing, so as to accommodate the ready application and insertion of an acceptable socket head or ratchet means therein, for seating and fastening or locking into position.

The wrench housing contains an internal aperture, shaped and configured to provide for the mating reception of a socket wrench or ratchet means therein, so as to prevent its turning, once located and seated, and provide for ready transmission of any force generated upon the handle, to the installed wrench, for usage in the forced turning of a bolt, nut, or other fastening means.

It must be stated herein that the various types of socket wrenches, or ratchet wrenches or means, are of the type that are readily available in the art, but which may contain an outer housing that is complementary shaped so as to provide for their insertion within the wrench housing, once installed.

Variations or modifications to the subject matter of this invention may occur to those skilled in the art upon reviewing the summary herein, and upon undertaking a study of the description of its preferred embodiment, in view of the drawings.

DESCRIPTION OF THE PREFERRED EMBODIMENT

Figure 1:
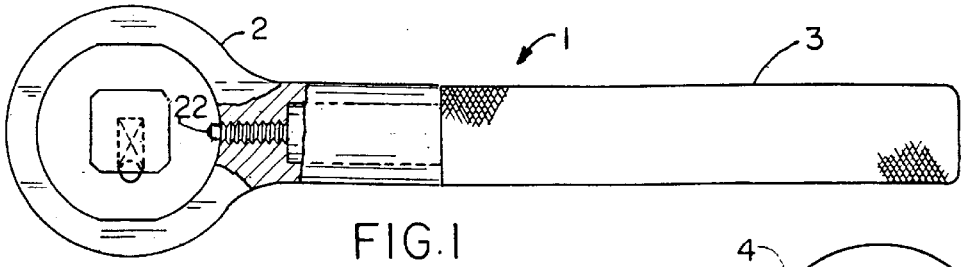
FIG. 1 is a front view of the socket wrench and ratchet attachment means of this invention.
Figure 2:
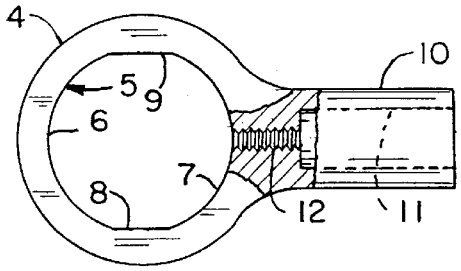
FIG. 2 is a front view of the wrench housing.
Figure 5:
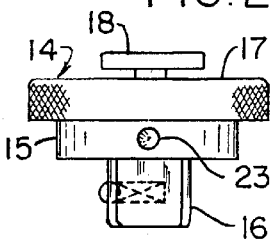
FIG. 5 is a side view of an insertable palm ratchet.
Figure 3:
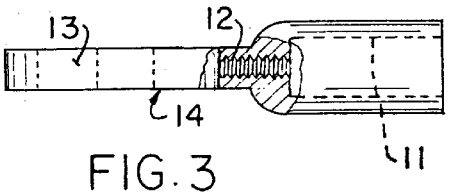
FIG. 3 is a side view of the wrench housing.

In referring to the drawings, and in particular FIG. 1, the socket wrench and ratchet attachment means 1 of this invention is readily disclosed. It is comprised of a wrench housing 2, formed at its forward end, and which connects, or has fastened therein, as along one side edge, the wrench handle 3. As can be seen in FIG. 2, the wrench housing includes an annular portion 4, which has a designed aperture 5 located therein, the aperture comprising a pair of diametrically opposed arcuate portions 6 and 7, intervened by a pair of straight internally arranged side walls 8 and 9, as noted. The annular portion 4 of the housing, along its bottom edge, is integrally formed having an extension, as at 10, and which is designed for accommodating therein the handle 3, as previously described. The extension 10 has a first bore 11, and a counterbore 12, the counterbore extending and communicating into the opening 5, within the housing, as previously explained. As can be seen in FIG. 3, the wrench housing 4 is of relatively thin design, as can be noted at 13, but is sufficiently thick so as to provide stability and sturdiness to the wrench, and its housing, when used for locating and fastening therein, as within its opening 5, a palm ratchet 14, of the style as shown in FIG. 5. The palm ratchet, as noted, is available upon the market, and includes an intermediate base 15, which is designed and shaped to interfit within the opening 5, of the housing 4, and extending from the intermediate base 15, in this particular instance, is a socket drive, as at 16, and which is provided for rotating in either direction, depending upon the setting of the ratchet drive mechanism, located at 17, as known in the art. The ratchet may be turned in either direction, to provide for either clockwise or counterclockwise drive, through the use of its setting means 18.

Figure 4:
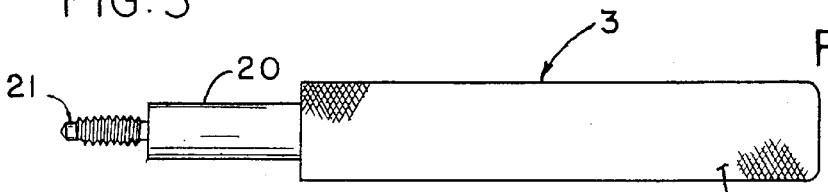
FIG. 4 is a side view of the wrench handle.

The wrench handle 3 is also disclosed in FIG. 4, and includes its knurled handle portion 19, which is of sufficient length, and desired diameter or circumference, to afford means for ready grasping by the hand of the user of the tool, when driving a bolt or nut or other fastening means into a tightened relationship, or for untightening of the same, during installation or removal. The handle 3 is of reduced diameter, at its forward end, as at 20, and has a diameter that is closely mated to that bore 11, as provided within the wrench housing 4, so as to provide a snug fitting therein, but yet allow the handle to be easily turned, when locating or removal of a ratchet means 14 within the housing. Forwardly of the reduced portion 20 is an extension 21, comprising a handle rod, which is shown as being threaded, and the extension 21 threadedly engages within the counterbore 12, so as to provide for a locating of the handle with respect to the housing 4, whereby the handle can be turned in one or the other direction, about its longitudinal axis, for either tightening of the handle within the housing 4, and thereby tightening of the ratchet 14 therein, or when the handle is turned in the opposite direction, disengaging the handle from the housing 4, so as to allow for removal of the ratchet means, or other socket drive. It is just as likely that the extension 21 may be unthreaded, but that the reduced portion 20 may be threaded, and threadedly engaged within the bore 11, to provide for means for engagement or disengagement of the handle within the housing 4, and to allow for the application or removal of a ratchet or other socket wrench within the housing aperture 5, as can be understood. As can be seen in FIG. 1, when the handle 3 is fully located within the socket housing 4, the forward tip 22, of the handle extension 21, projects into the opening 5, and locates within a complementary seat 23 provided upon the periphery of the intermediate section 15 of the ratchet 14, as can be seen in FIG. 5.

Figure 6:
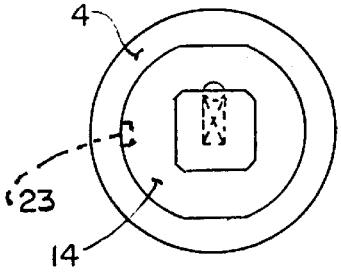
FIG. 6 is a front view of the palm ratchet of FIG. 5.
Figure 7:
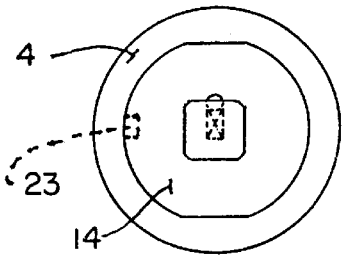
FIG. 7 is a front view of a different sized palm ratchet, located within the wrench housing.
Figure 8:
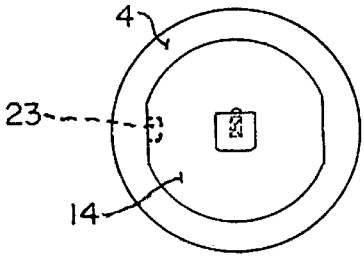
FIG. 8 is a front view of a different sized ratchet mounted within the wrench housing.

The appearance of the shape of the various socket wrenches or ratchet means 14, when inserted matingly within the aperture 5 of the associated wrench housing 4, can be seen in FIGS. 6 through 8. As noted, the external periphery of the ratchet means 14 conforms closely to the shape of the aperture or opening 5, formed within the wrench housing, as can be noted, so that the ratchet means, or a socket wrench, can snugly fit therein, and be tightened in position by means of the turning of the wrench handle 3 to the position where its extension 21 locates and seats within the cavity 23, of the shown ratchet or wrench.

Variations or modifications to the subject matter of this invention may occur to those skilled in the art upon reviewing the description as provided within the specification. Such variations or modifications, are intended to be encompassed within the scope of the invention as described herein. The description of the preferred embodiment, and as shown in the drawings, is set forth for illustrative purposes only.

Having thus described the invention, what is claimed and desired to be secured by Letters Patent is:

1. A socket wrench and ratchet attachment comprising:

a ratcheting mechanism;

a wrench handle having a neck portion and a rod extending from the neck portion;

a wrench housing having a generally annular portion and an extension extending from the annular portion; the annular portion defining an opening sized to accept a ratcheting mechanism; said annular portion having at least one straight side wall, and said ratcheting mechanism also having at least one straight side wall and provided to mate against the side wall of the wrench housing when inserted therein; the extension having a first bore sized to accept the handle neck, and a counterbore at an end of the first bore sized to accept the rod; the counterbore communicating with the annular portion of the wrench housing;

said handle rod is sized to extend through the wrench housing counterbore to extend into the opening of the annular portion to engage the ratcheting mechanism when received in the wrench housing;

said handle rod and wrench housing counterbore are threaded so that the handle can be screwed into the wrench housing;

said threaded rod may be screwed into the wrench housing counterbore to bear against the ratcheting mechanism to hold the ratchet mechanism in the wrench housing opening, and wherein the threaded rod can be unscrewed from the wrench housing counterbore, and out of contact with the ratcheting mechanism to allow the ratcheting mechanism to be removed from the wrench housing.

* * * * *